US011450282B2

(12) United States Patent
Park et al.

(10) Patent No.: US 11,450,282 B2
(45) Date of Patent: Sep. 20, 2022

(54) DISPLAY DEVICE

(71) Applicant: SAMSUNG DISPLAY CO., LTD., Yongin-si (KR)

(72) Inventors: Chae Hee Park, Yongin-si (KR); Jong Soo Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/205,119

(22) Filed: Mar. 18, 2021

(65) Prior Publication Data

US 2022/0044641 A1 Feb. 10, 2022

(30) Foreign Application Priority Data

Aug. 10, 2020 (KR) ..... 10-2020-0100139

(51) Int. Cl.
*G09G 3/3275* (2016.01)

(52) U.S. Cl.
CPC ..... *G09G 3/3275* (2013.01); *G09G 2310/027* (2013.01); *G09G 2310/0286* (2013.01); *G09G 2310/08* (2013.01)

(58) Field of Classification Search
CPC ..... G09G 3/3275; G09G 2310/027; G09G 2310/08; G09G 2310/0286
See application file for complete search history.

(56) References Cited

U.S. PATENT DOCUMENTS

| | | | | |
|---|---|---|---|---|
| 5,438,342 | A * | 8/1995 | Yamaguchi | G09G 3/3614 345/58 |
| 7,570,257 | B2 * | 8/2009 | Ikeda | G09G 3/3233 315/169.3 |
| 8,120,553 | B2 * | 2/2012 | Kim | G09G 3/3233 345/76 |
| 8,330,691 | B2 * | 12/2012 | Tanimoto | G09G 3/20 345/92 |
| 9,001,111 | B2 * | 4/2015 | Mizusako | G09G 3/3614 345/212 |
| 9,286,820 | B2 * | 3/2016 | Chang | G09G 3/20 |
| 9,373,294 | B2 * | 6/2016 | Chen | G09G 3/36 |
| 9,576,546 | B2 * | 2/2017 | Lee | G09G 3/3688 |
| 9,620,077 | B2 * | 4/2017 | Shih | H01L 29/42384 |
| 9,626,925 | B2 * | 4/2017 | Cheng | G09G 3/3688 |
| 9,830,852 | B2 * | 11/2017 | Kim | G09G 3/3225 |
| 9,875,714 | B2 | 1/2018 | Lee et al. | |
| 10,157,586 | B2 * | 12/2018 | Koh | G09G 3/3696 |
| 10,324,319 | B2 * | 6/2019 | Lee | G02F 1/136286 |
| 10,580,339 | B2 * | 3/2020 | Lim | G09G 3/006 |

(Continued)

FOREIGN PATENT DOCUMENTS

| | | | |
|---|---|---|---|
| KR | 1020160053333 | A | 5/2016 |
| KR | 1020180018889 | A | 2/2018 |
| KR | 1020180027270 | A | 3/2018 |

*Primary Examiner* — Michael J Jansen, II
(74) *Attorney, Agent, or Firm* — Cantor Colburn LLP

(57) ABSTRACT

A display device includes: a dummy data unit connected to one end portion of a data line, where the dummy data unit supplies a dummy data signal to the data line; a sensing unit connected to an opposing end portion of the data line, where the sensing unit determines a load of the data line based on the dummy data signal supplied thereto through the data line; and a timing controller which controls a supply timing of a data signal to be supplied to the data line, based on the load.

19 Claims, 15 Drawing Sheets

(56) References Cited

U.S. PATENT DOCUMENTS

| | | | | |
|---|---|---|---|---|
| 10,593,268 | B2 * | 3/2020 | An | G09G 3/3291 |
| 10,755,648 | B2 * | 8/2020 | Kim | G09G 3/3688 |
| 10,916,190 | B2 * | 2/2021 | Kim | G06F 3/0412 |
| 2006/0221012 | A1 * | 10/2006 | Ikeda | G09G 3/3266 345/76 |
| 2007/0132673 | A1 * | 6/2007 | Jinno | G09G 3/006 345/76 |
| 2008/0180364 | A1 * | 7/2008 | Kim | G09G 3/3233 345/76 |
| 2009/0231255 | A1 * | 9/2009 | Tanimoto | G02F 1/136286 345/87 |
| 2010/0085293 | A1 * | 4/2010 | Lee | G09G 3/3688 345/94 |
| 2011/0012892 | A1 * | 1/2011 | Chen | G09G 3/3648 345/87 |
| 2013/0069928 | A1 * | 3/2013 | Mizusako | G09G 3/3611 345/212 |
| 2015/0001540 | A1 * | 1/2015 | Chang | G09G 3/20 257/59 |
| 2015/0022513 | A1 * | 1/2015 | Kim | G09G 3/3225 345/212 |
| 2015/0325593 | A1 * | 11/2015 | Shih | H01L 27/124 345/206 |
| 2016/0125821 | A1 * | 5/2016 | Lee | G09G 3/3688 345/92 |
| 2016/0284297 | A1 * | 9/2016 | Cheng | G09G 3/3648 |
| 2016/0365066 | A1 * | 12/2016 | Lim | G09G 3/006 |
| 2017/0221443 | A1 * | 8/2017 | Koh | G09G 3/3696 |
| 2018/0046007 | A1 * | 2/2018 | Lee | G09G 3/3688 |
| 2018/0137825 | A1 * | 5/2018 | An | G11C 19/28 |
| 2019/0347999 | A1 * | 11/2019 | Kim | H01L 27/3276 |
| 2020/0211456 | A1 * | 7/2020 | Kim | G09G 3/3655 |
| 2022/0044641 | A1 * | 2/2022 | Park | G09G 3/3275 |

* cited by examiner

DISPLAY DEVICE

This application claims priority to Korean patent application 10-2020-0100139, filed on Aug. 10, 2020, and all the benefits accruing therefrom under 35 U.S.C. § 119, the content of which in its entirety is herein incorporated by reference.

BACKGROUND

1. Field

The disclosure generally relates to a display device.

2. Related Art

A display device typically includes data lines, gate lines, pixels connected thereto, a gate driver for outputting a gate signal to the gate line, a data driver for outputting a data signal to the data line, and a timing controller for controlling the drivers.

When a thin film transistor is turned on by applying the gate signal to the gate line, the data signal applied to the data line is charged as a pixel voltage in the pixel.

SUMMARY

In a display device, a delay time of data signal applied to a pixel may increase as a distance of the pixel from a data driver increases. Since a charging rate of a pixel voltage of a pixel decreases as the distance of the pixel from the data driver increases, the display quality of the display device may be deteriorated.

Embodiments provide a display device in which a supply timing of a data signal supplied to a data line is controlled based on a data load of the data line, so that a charging time of a pixel voltage may be secured.

In accordance with an embodiment of the disclosure, a display device includes: a dummy data unit connected to one end portion of a data line, where the dummy data unit supplies a dummy data signal to the data line; a sensing to unit connected to an opposing end portion of the data line, where the sensing unit determines a load of the data line based on the dummy data signal supplied thereto through the data line; and a timing controller which controls a supply timing of a data signal to be supplied to the data line, based on the load.

In an embodiment, the display device may further include: a data driver which supplies the data signal to the data line; and a gate driver which supplies a gate signal to a gate line.

In an embodiment, the dummy data unit may be disposed in the gate driver, and the sensing unit may be disposed in the data driver.

In an embodiment, the display device may further include: a connection line electrically connecting the dummy data unit and the data line to each other; and a switching element connected between the connection line and the dummy data unit.

In an embodiment, the data line supplied with the dummy data signal may be disposed adjacent to the gate driver.

In an embodiment, the switching element may be turned on when the dummy data signal is supplied to the data line, and maintain a turn-off state when the data signal is supplied to the data line.

In an embodiment, the sensing unit may include: a converter which converts the dummy data signal into dummy delay data in a digital form; and a delay calculator which generate a data delay value based on the dummy delay data.

In an embodiment, the data delay value may be a first delay value corresponding to a biggest load of the data line.

In an embodiment, the delay calculator may pre-store a second data delay value corresponding to a smallest load and additionally calculate a third data delay value corresponding to an intermediate load based on the first data delay value and the second data delay value.

In an embodiment, the data driver may include: a shift register which generates an activation signal; a holding latch which is supplied with and sequentially store data from the timing controller in response to the activation signal; a control latch simultaneously supplied with the data stored in the holding latch when a source output enable signal is supplied; a digital-to-analog converter which is supplied with the data from the control latch when the source output enable signal is supplied to the control latch, and generates the data signal based on the data supplied thereto from the control latch; and a buffer which transfers the data signal to the data line.

In an embodiment, the timing controller may control a supply timing of the data signal by changing a supply timing of the source output enable signal.

In an embodiment, the dummy data unit may be disposed at one end portion of the gate driver, and the sensing unit may be disposed at an opposing end portion of the gate driver.

In an embodiment, the display device may further include: a first connection line electrically connecting the dummy data unit and the data line to each other; a second connection line electrically connecting the sensing unit and the data line to each other; a first switching element connected between the first connection line and the dummy data unit; and a second switching element connected between the second connection line and the sensing unit.

In an embodiment, a line electrically connecting the dummy data unit and the sensing unit to each other may be a dummy data line.

In an embodiment, the sensing unit may be electrically connected to at least two points of a specific gate line and determine a load of the specific gate line based on a gate signal supplied thereto from the at least two points.

In an embodiment, the specific gate line may be disposed adjacent to the data driver.

In an embodiment, the sensing unit may include: a first converter which converts the dummy data signal into dummy delay data in a digital form; a second converter which converts the gate signal into gate sensing data in a digital form; and a delay calculator which generates a data delay value based on the dummy delay data and the gate sensing data.

In an embodiment, the data driver may include: a first data driver disposed at one side of a display panel; and a second data driver provided at an opposing side of the display panel. In such an embodiment, the dummy data unit may be disposed in the first data driver, and the sensing unit is disposed in the second data driver.

In an embodiment, the dummy data unit may be disposed in the data driver disposed at one side of a display panel, and the sensing unit may be disposed at an opposing side of the display panel or in the gate driver. In such an embodiment, the display device may further include a connection line electrically connecting the sensing unit and the data line to each other.

In an embodiment, the timing controller may further include a source output enable signal controller which controls a supply timing of the data signal; an over-driving controller which controls an over-driving voltage, based on the load; and an amplifier bias controller which controls a bias current supplied to amplifiers included in the data driver, based on the load.

In embodiments of the display device in accordance with the disclosure, the supply timing of a data signal to be supplied to a data line is controlled based on a data load of a data line, so that a charging time of the pixel voltage may be effectively secured. Accordingly, the quality of an image displayed in the display device may be improved.

BRIEF DESCRIPTION OF THE DRAWINGS

The above and other features of the invention will become more apparent by describing in further detail embodiments thereof with reference to the accompanying drawings.

DETAILED DESCRIPTION

Figure 1:
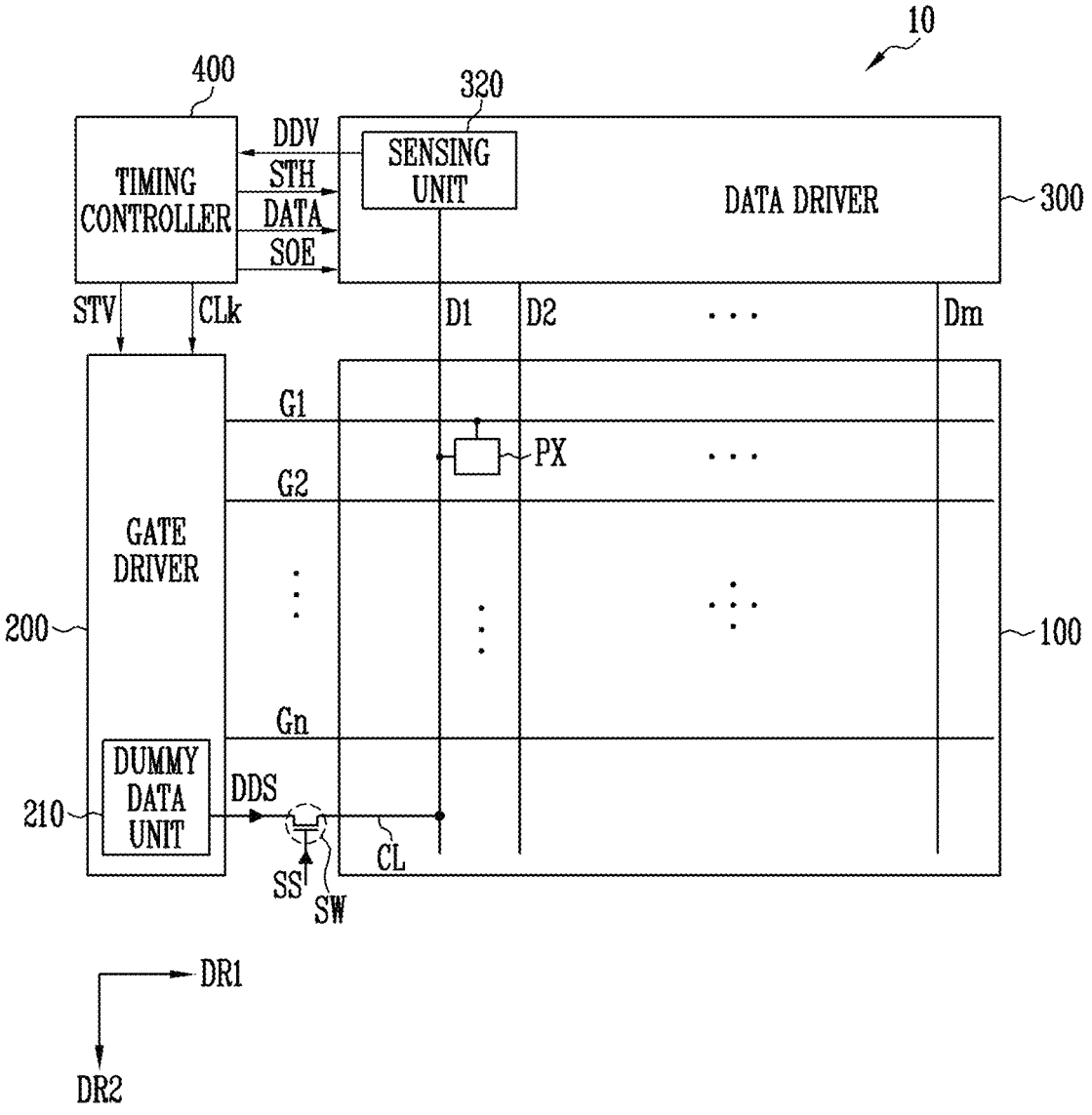
FIG. 1 is a diagram illustrating a display device in accordance with embodiments of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

A part irrelevant to the description will be omitted to clearly describe the disclosure, and the same or similar constituent elements will be designated by the same reference numerals throughout the specification. Therefore, the same reference numerals may be used in different drawings to identify the same or similar elements.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a diagram illustrating a display device in accordance with embodiments of the disclosure.

In an embodiment of the disclosure, for convenience of description, a lateral direction (or a horizontal direction) on a plane is referred to as a first direction DR1, and a longitudinal direction (or a vertical direction) on a plane is referred to as a second direction DR2. The first and second directions DR1 and DR2 may mean directions which the first and second directions DR1 and DR2 respectively indicate.

Referring to FIG. 1, an embodiment of a display device 10 may include a display panel 100, a gate driver 200, a data driver 300, and a timing controller 400.

The display panel 100 may display an image, and include gate lines G1 to Gn and data lines D1 to Dm. The gate lines G1 to Gn may extend in the first direction DR1, and be sequentially arranged along the second direction DR2. The data lines D1 to Dm may extend in the second direction DR2, and be sequentially arranged in the first direction DR1.

Pixels PX may be disposed in areas in which the gate lines G1 to Gn and the data lines D1 to Dm intersect each other, or be disposed in areas defined by the gate lines G1 to Gn and the data lines D1 to Dm.

Each of the pixels PX is connected to a corresponding gate line among the gate lines G1 to Gn and a corresponding data line among the data lines D1 to Dm. Each of the pixels PX is supplied with a data signal through the corresponding data line connected thereto when a gate signal is supplied to the corresponding gate line connected thereto, and emits light with a luminance corresponding to the supplied data signal.

In an embodiment, each of the pixels PX may include a light emitting element, a switching transistor which transfers a data signal in response to a gate signal, a storage capacitor which stores the data signal transferred through the switching transistor, and a driving transistor which provides a driving current to the light emitting element, corresponding to the stored data signal. The light emitting device may be an organic light emitting element or an inorganic light emitting element.

The timing controller 400 may control the gate driver 200 and the data driver 300. The timing controller 400 may receive data and a control signal from an outside, and generate a gate control signal STV and CLk and a data control signal STH and SOE, based on the control signal. The timing controller 400 may supply the gate control signal STV and CLk to the gate driver 200, and supply the data control signal STH and SOE to the data driver 300. Also, the timing controller 400 may supply image data DATA to the data driver 300.

The gate driver 200 and the data driver 300 may drive the display panel 100.

The gate driver 200 may generate gate signals in response to a vertical start signal STV and a clock signal CLk, which are provided from the timing controller 400, and output the gate signals to the gate lines G1 to Gn.

The data driver 300 may generate data signals (or data voltages), based on the image data DATA and the data control signal STH and SOE, which are provided from the timing controller 400, and output the data signals to the data lines D1 to Dm.

A dummy data unit 210 may be connected to one end portion of at least one data line among the data lines D1 to Dm, and a sensing unit 320 may be connected to an opposing end portion of the at least one data line among the data lines D1 to Dm.

In an embodiment, the dummy data unit 210 may be disposed in the gate driver 200. The dummy data unit 210 may be provided in an end portion of the gate driver 200. In an embodiment, although not shown in FIG. 1, the dummy data unit 210 may be provided along the second direction DR2 downwardly of a gate integrated circuit (not shown) connected to an n-th gate line Gn.

The dummy data unit 210 may supply a dummy data signal DDS to a connection line CL. The dummy data signal DDS may be a data voltage having a specific voltage value within a predetermined voltage range (e.g., a voltage in a range of 3 volts (V) to 9 V) of the data signal.

The connection line CL may electrically connect a data line of the data lines D1 to Dm to the dummy data unit 210. The data line connected to the dummy data unit 210 through the connection line CL may be a data line disposed adjacent to the gate driver 200. In an embodiment, the data line connected to the dummy data unit 210 through the connection line CL as shown in FIG. 1 may be a first data line D1 disposed adjacent to the gate driver 200.

A switching element SW may be further provided or connected between the connection line CL and the dummy data unit 210.

The switching element SW may be turned on when no data signal is supplied along the data lines D1 to Dm from the data driver 300. In an embodiment, the switching element SW may be turned on at least once in a manufacturing process of the display panel 100. This will be described in detail later.

When the display panel 100 is normally driven, e.g., when a data signal is supplied to the data lines D1 to Dm from the data driver 300, the switching element SW maintains a turn-off state.

The switching element SW may be turned on or turned off by a control signal SS. In an embodiment, the control signal SS may be a signal supplied from an outside during the manufacturing process, but the disclosure is not limited thereto. In an alternative embodiment, the control signal SS may be supplied to the switching element SW from the timing controller 400.

In an embodiment, the opposing end portion of the data line electrically connected to the dummy data unit 210 through the connection line CL (e.g., the first data line D1) may be connected to the sensing unit 320. In such an embodiment, the opposing end portion of the first data line D1 electrically connected to the dummy data unit 210 through the connection line CL may be connected to the sensing unit 320.

In an embodiment, the sensing unit 320 may be provided in the data driver 300. However, the disclosure is not limited thereto, and alternatively, the sensing unit 320 may be provided in the timing controller 400.

The switching element SW may be set to a turn-on state in a period, in which a load of the data lines D1 to Dm is sensed or detected in the manufacturing process, etc. The dummy data unit 210 supplies the dummy data signal DDS to the sensing unit 320 via the first data line D1. The dummy data signal DDS supplied to the sensing unit 320 may be delayed for a predetermined time, corresponding to a load component of the data line, e.g., the first data line D1, to which the dummy data signal DDS is supplied.

The sensing unit 320 may determine a load of the first data line D1 by using the received dummy data signal DDS, and supply a data delay value DDV corresponding to the determined load to the timing controller 400. The timing controller 400 may generate a source output enable signal SOE for controlling a timing of the data signal supplied to the data lines D1 to Dm, based on the supplied data delay value DDV.

The timing controller 400 may supply the source output enable signal SOE to the data driver 300. A configuration and signal conversion of the sensing unit 320 will be described later in detail with reference to FIG. 3.

Figure 2A:
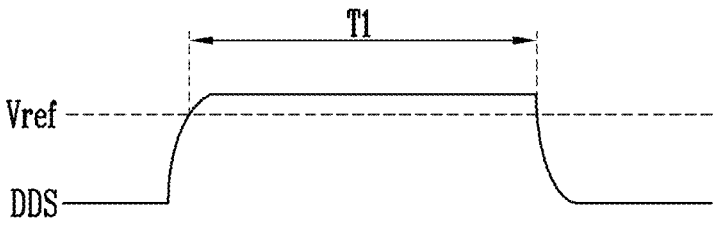
FIG. 2A illustrates a dummy data signal supplied from a dummy data unit.
Figure 2B:
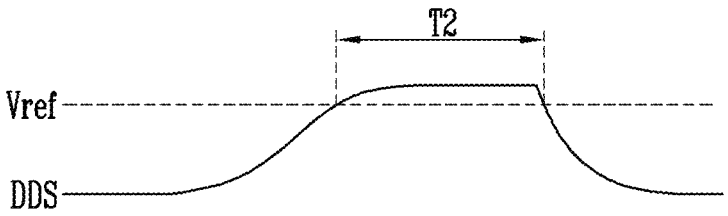
FIG. 2B illustrates a dummy data signal input to a sensing unit via a data line.
Figure 2C:
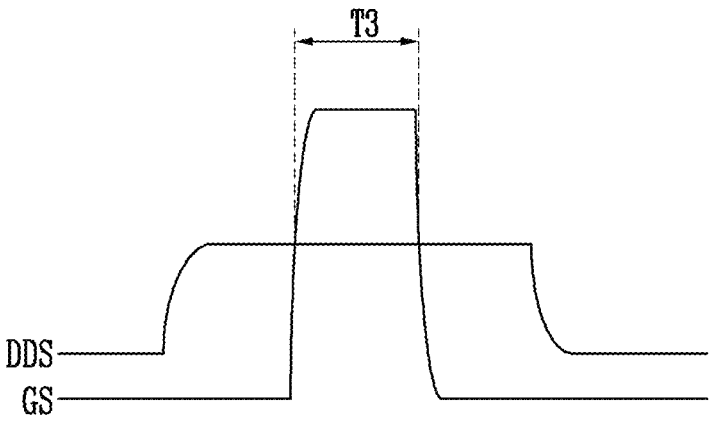
FIGS. 2C and 2D are diagrams illustrating a timing of a gate signal to be supplied with respect to the dummy data signal.
Figure 2D:
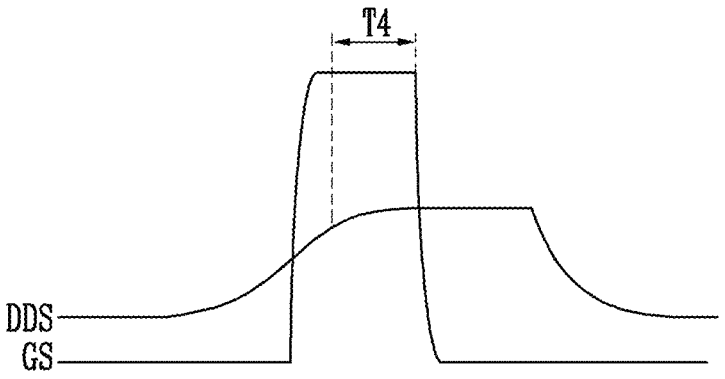

FIG. 2A illustrates a dummy data signal supplied from the dummy data unit, FIG. 2B illustrates a dummy data signal input to the sensing unit via a data line, and FIGS. 2C and 2D are diagrams illustrating a timing of a gate signal to be supplied with respect to the dummy data signal.

FIG. 2C is a diagram illustrating comparison between the dummy data signal shown in FIG. 2A and the gate signal, and FIG. 2D is a diagram illustrating comparison between the dummy data signal shown in FIG. 2B and the gate signal.

Referring to FIG. 1, the dummy data signal DDS supplied from the dummy data unit 210 is supplied to the sensing unit 320 via the first data line D1.

The dummy data signal DDS may have a waveform (or voltage, etc.) changed due to the load of the first data line D1. In an embodiment, as compared with a constant reference voltage Vref, the dummy data signal DDS output from the dummy data unit 210 may be set to a voltage higher than the reference voltage Vref during a first time period T1 as shown in FIG. 2A.

In an embodiment, as compared with the reference voltage Vref, the dummy data signal DDS input to the sensing unit 320 via the first data line D1 may have a voltage higher than the reference voltage Vref during a second time period T2 shorter than the first time period T1 as shown in FIG. 2B.

In such an embodiment, as described above, when the voltage (or waveform) of the dummy data signal DDS is changed by the load of the first data line D1, different voltages may be charged in the pixels PX, corresponding to positions of the data driver 300 and the pixels PX, even when a same data signal is supplied. The pixels PX may generate light with different luminances, based on a same data signal.

FIGS. 2C and 2D are diagrams illustrating a timing of a gate signal GS to be supplied with respect to the dummy data signal DDS.

Referring to FIG. 2C, when the dummy data signal DDS is not delayed, the gate signal GS and the dummy data signal DDS may overlap with the biggest voltage of the dummy data signal DDS during a third time period T3. Accordingly, the gate signal GS and the dummy data signal DDS may be stably supplied to the pixel PX during the third time period T3.

However, referring to FIG. 2D, when the dummy data signal DDS is delayed, the gate signal GS may overlap with the biggest voltage of the dummy data signal DDS during a fourth time period T4 shorter than the third time period T3. Accordingly, a voltage supplied to the pixel PX may not be sufficient to emit light with a predetermined luminance.

Figure 3:
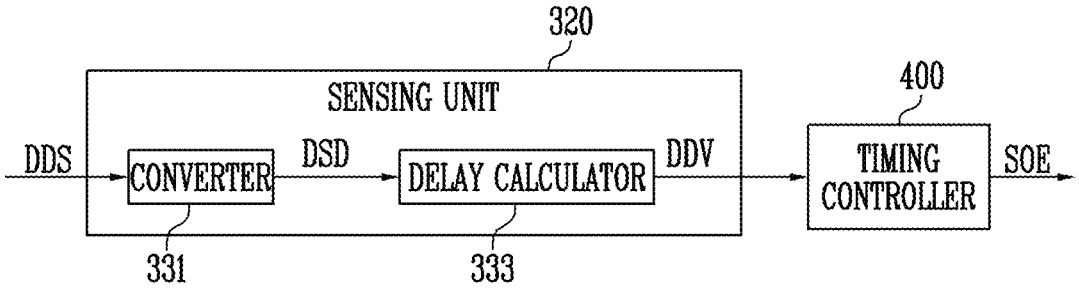
FIG. 3 is a block diagram illustrating an embodiment of the sensing unit shown in FIG. 1.
Figure 4:
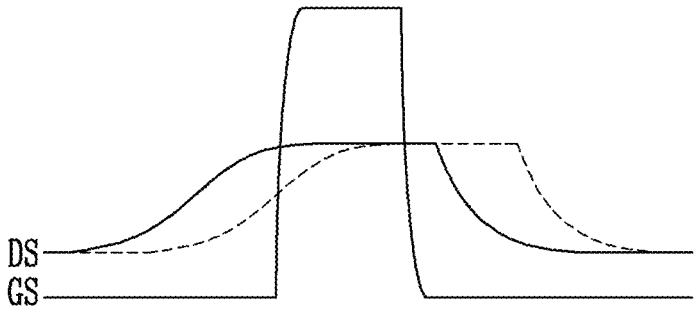
FIG. 4 is a waveform diagram illustrating a supply time of a data signal controlled by a timing controller.

FIG. 3 is a block diagram illustrating an embodiment of the sensing unit shown in FIG. 1. FIG. 4 is a waveform diagram illustrating a supply time of a data signal controlled by the timing controller.

Referring to FIG. 3, an embodiment of the sensing unit 320 may include a converter 331 and a delay calculator 333.

The converter 331 may convert the dummy data signal DDS into a digital signal. In such an embodiment, the converter 331 may be an analog-to-digital converter ("ADC"). The converter 331 may convert the dummy data signal DDS in an analog form into a dummy delay data DSD. The dummy delay data DSD may be a digital value for calculating a charging time.

In an embodiment, the converter 331 may compare the reference voltage Vref and the dummy data signal DDS as shown in FIG. 2B, and output the dummy delay data DSD in a digital form, based on a comparison result. The dummy delay data DSD may have a value corresponding to the second time during T2.

The converter 331 may supply the dummy delay data DSD to the delay calculator 333. The delay calculator 333 may calculate a data delay value DDV of a data signal to be delayed.

In an embodiment, the delay calculator 333 may determine a supply time of the second time T2 of the dummy data signal DDS, based on the dummy delay data DSD, and calculate the data delay value DDV such that the supply time of the second time T2 may be set to a desired time. In such an embodiment, the delay calculator 333 may calculate the data delay value DDV with which the gate signal GS and the biggest voltage of a data signal DS may maximally overlap with each other as shown in FIG. 4.

In an embodiment, the dummy delay data DSD is a value corresponding to the biggest load of the first data line D1. The delay calculator 333 may additionally calculate a data delay value DDV corresponding to the smallest load from the biggest load by using the dummy delay data DSD.

In an embodiment, a data delay value DDV corresponding to a case where any delay does not occur as shown in FIG. 2A, i.e., the smallest load may be pre-stored in the delay calculator 333. The data delay value DDV corresponding to the pre-stored smallest load may be second data delay value. In an embodiment, the second data delay value may be "00000000."

In such an embodiment, the delay calculator 333 calculates a data delay value DDV corresponding to the biggest load calculated by using the dummy delay data DSD as described above. The data delay value DDV corresponding to the biggest load calculated by using the dummy delay data DSD may be first data delay value. In an embodiment, the first data delay value may be "01001111."

Subsequently, the delay calculator 333 may additionally calculate delay values between the biggest load and the smallest load by using the data delay value DDV corresponding to the biggest load and the data delay value DDV corresponding to the smallest load. Data delay values DDV corresponding to intermediate loads calculated by using the data delay value DDV corresponding to the biggest load and the data delay value DDV corresponding to the smallest load may be third data delay values. In an embodiment, the third data delay values may have any one of values between "01001111" and "00000000".

The data delay value DDV generated by the delay calculator 333 is supplied to the timing controller 400.

The timing controller 400 may generate a source output enable signal SOE, based on the supplied data delay value DDV. The source output enable signal SOE may be a signal for controlling an output timing of the data signal DS supplied from the data driver 300.

The timing controller 400 may generate the source output enable signal SOE, based on an order in which the data signal DS is supplied and the data delay value DDV. In an embodiment, the timing controller 400 may control a supply timing of the data signal DS to be supplied later, based on the data delay value DDV corresponding to the biggest load of the first data line D1. In such an embodiment, the timing controller 400 may control a supply timing of the data signal DS to be supplied first of all, based on the data delay value DDV corresponding to the smallest load of the first data line D1.

In an embodiment of the disclosure, as described above, a load of the first data line D1 is determined by using the dummy data signal DDS measured by the sensing unit 320, and the supply time of the data signal is controlled as shown in FIG. 4 such that a data signal DS corresponding to the determined load may be stably supplied to the pixel PX.

In such an embodiment of the disclosure, the first data line D1 and the other data lines D2 to Dm may have a substantially same load as each other. In such an embodiment, the data lines D1 to Dm formed through a same process are set to have a same load as each other or similar loads to each other, and accordingly, a load of all the other data lines D2 to Dm may be determined by using the dummy delay data DSD of one data line (i.e., the first data line D1).

Figure 5:
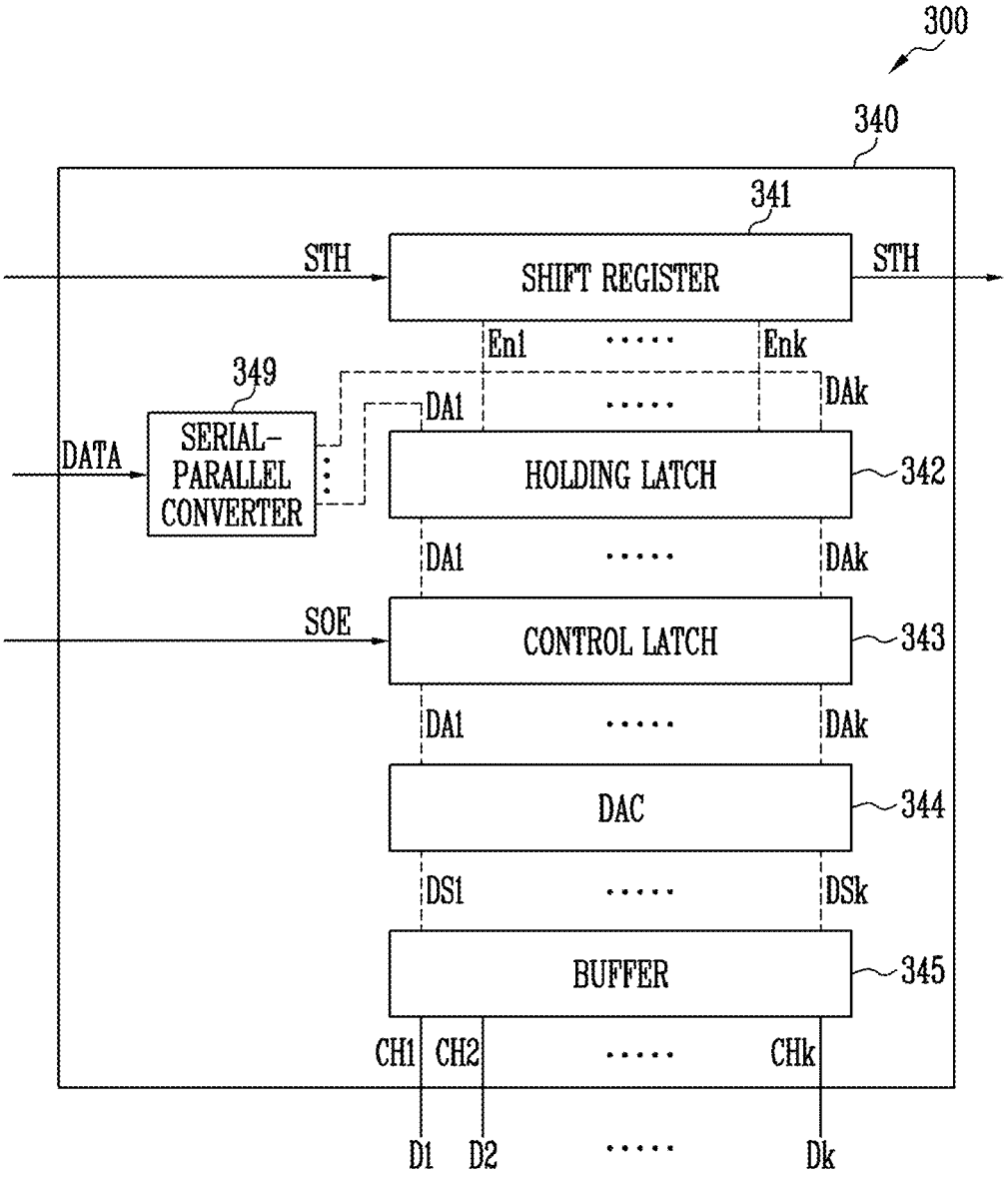
FIG. 5 is a block diagram illustrating one of a plurality of data integrated circuits included in a data driver.

FIG. 5 is a block diagram illustrating one of a plurality of data integrated circuits included in the data driver.

Referring to FIG. 5, in an embodiment, a plurality of data integrated circuits 340 may be included in the data driver 300. The data integrated circuit 340 may be supplied with a horizontal start signal STH, image data DATA, and a source output enable signal SOE from the timing controller 400.

The data integrated circuit 340 may output data signals DS1 to DSk generated therein through a plurality of channels CH1 to CHk. The data signals DS1 to DSk output from the data integrated circuit 340 may have different output timings from each other.

An embodiment of the data integrated circuit 340 may include a shift register 341, a serial-parallel converter 349, a holding latch 342, a control latch 343, a digital-to-analog converter ("DAC") 344, and a buffer 345.

In an embodiment, the shift register 341 may receive the horizontal start signal STH, and shift the horizontal start signal STH to a next data integrated circuit. In such an embodiment, the shift register 341 may sequentially output first to k-th activation signals En1 to Enk to the holding latch 342, based on the shift of the horizontal start signal STH.

The serial-parallel converter 349 may receive the image data DATA, convert the image data DATA into first to k-th parallel data DA1 to DAk, and output the first to k-th parallel data DA1 to DAk to the holding latch 342.

The holding latch 342 may sequentially and temporarily store the first to k-th parallel data DA1 to DAk in response to the sequentially supplied first to k-th activation signals En1 to Enk. The holding latch 342 may output the stored first to k-th parallel data DA1 to DAk to the control latch 343.

The control latch 343 may receive first to k-th parallel data DA1 to DAk corresponding to a current pixel row, based on the source output enable signal SOE, and simultaneously, supply, to the DAC 344, first to k-th parallel data DA1 to DAk corresponding to a previous pixel row, which are stored therein.

The control latch 343 may supply, to the DAC 344, the first to k-m th parallel data DA1 to DAk stored therein when the source output enable signal SOE is supplied. That is, the output timing of the first to k-th parallel data DA1 to DAk of the control latch 343 may be controlled by the source output enable signal SOE.

The source output enable signal SOE controls the supply timing based on a load of the data lines D1 to Dm, and accordingly, the data signal DS may be supplied at a desired time, based on the load of the data lines D1 to Dm.

Therefore, in an embodiment, the timing controller 400 may supply the source output enable signal SOE having different timings for every horizontal line (i.e., for every pixel row). In such an embodiment, the timing controller 400 may supply the source output enable signal SOE having different timings for every horizontal lines.

The DAC 344 may generate data signals DS1 to DSk by using the first to k-th parallel data DA1 to DAk. The data signals DS1 to DSk generated by the DAC 344 may be supplied to data lines D1 to Dk via the buffer 345.

Figure 6A:
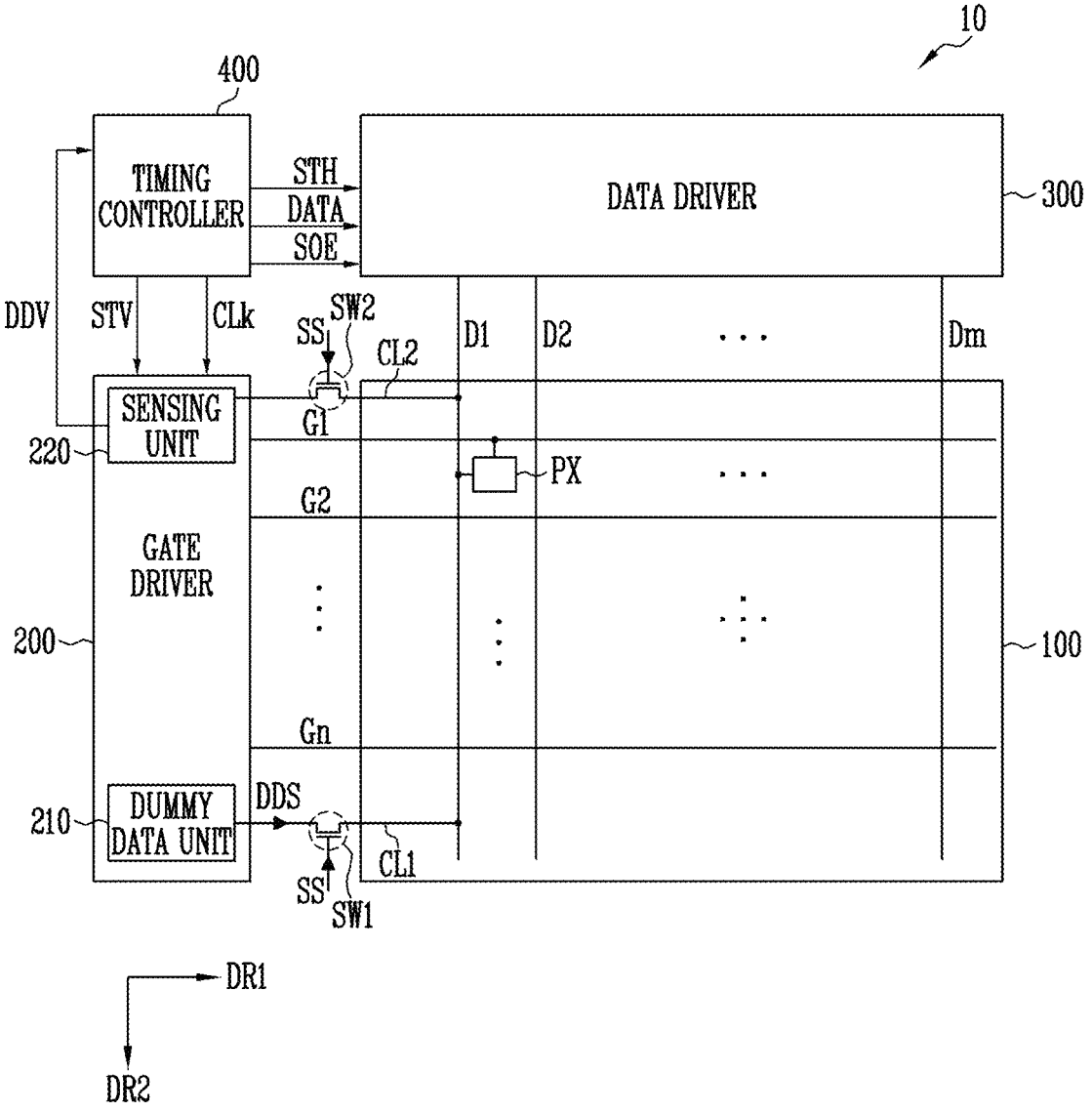
FIGS. 6A and 6B are diagrams illustrating display devices in accordance with alternative embodiments of the disclosure.
Figure 6B:
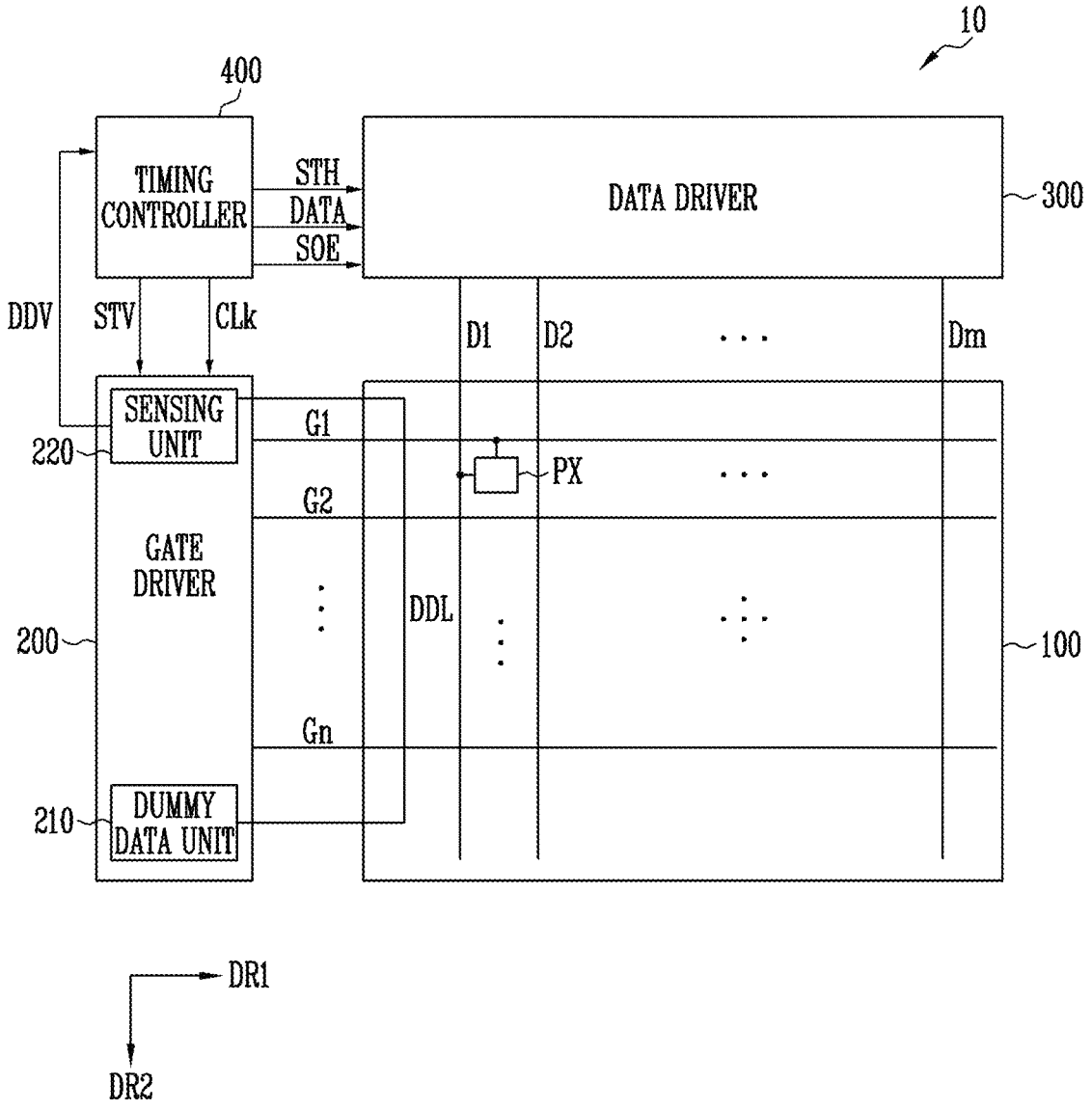

FIGS. 6A and 6B are diagrams illustrating display devices in accordance with alternative embodiments of the disclosure.

In FIG. 6A, the same or like elements have been labeled with the same reference characters as used above to describe the embodiment shown in FIG. 1, and any repetitive detailed description thereof will hereinafter be omitted or simplified for convenience of description.

Referring to FIG. 6A, in an alternative embodiment, the dummy data unit 210 may be disposed at one end portion of the gate driver 200, and the sensing unit 220 may be disposed at an opposing end portion of the gate driver 200.

The dummy data unit 210 may supply a dummy data signal DDS, and the sensing unit 220 may receive the dummy data signal DDS.

In such an embodiment, the dummy data unit 210 is connected to one end portion of one data line among the data lines D1 to Dm via a first connection line CL1. In such an embodiment, the sensing unit 220 is connected to an opposing other end portion of the one data line among the data lines D1 to Dm via a second connection line CL2.

The data line connected to the first connection line CL1 and the second connection line CL2 may be a data line most adjacent to the gate driver 200. In an embodiment, the data line most adjacent to the gate driver 200 may be the first data line D1.

A first switching element SW1 may be provided or connected between the first connection line CL1 and the dummy data unit 210, and a second switching element SW2 may be provided or connected between the second connection line CL2 and the sensing unit 220.

The first switching element SW1 controls connection between the first connection line CL1 and the dummy data unit 210, and the second switching element SW2 controls between the second connection line CL2 and the sensing unit 220.

The first switching element SW1 and the second switching to element SW2 are simultaneously turned on, and simultaneously maintain the turn-off state. The first switching element SW1 and the second switching element SW2 are turned on in a period (e.g., a process period) in which a load of the data lines D1 to Dm is sensed or detected, and maintain the turn-off state in the other period.

When the first switching element SW1 and the second switching element SW2 are turned on, the dummy data signal DDS from the dummy data unit 210 is supplied to the sensing unit 220 via the first data line D1. Then, the sensing unit 220 may determine a load of the data lines D1 to Dm by using the dummy data signal DDS. Other features of such an embodiment are substantially the same as those described with reference to FIGS. 1 to 5, and therefore, any repetitive detailed description thereof will be omitted.

In an alternative embodiment, the positions of the sensing unit 220 and the dummy data unit 210 in the gate driver 200 may be modified. In an alternative embodiment, the dummy data unit 210 may be disposed in an upper side portion (the opposing end portion) of the gate driver 200, and the sensing unit 320 may be disposed in a lower side portion (the one end portion) of the gate driver 200.

FIG. 6B is a diagram illustrating a display device in accordance with another alternative embodiment.

In FIG. 6, the same or like elements have been labeled with the same reference characters as used above to describe the embodiment shown in FIG. 6A, and any repetitive detailed description thereof will hereinafter be omitted or simplified for convenience of description.

Referring to FIG. 6B, in another alternative embodiment, the dummy data unit 210 and the sensing unit 220 may be connected to each other via a separate dummy data line DDL. The dummy data line DDL may be disposed adjacent to the gate driver 200, and be provided in the display panel 100 to intersect the gate lines G1 to Gn.

The dummy data unit 210 may be connected to one end portion (or the opposing end portion) of the dummy data line DDL, and the sensing unit 220 may be connected to the opposing end portion (or the one end portion) of the dummy data line DDL.

An operation process of the dummy data unit 210 and the sensing unit 220 is the substantially same as those described above, and therefore, any repetitive detailed description will be omitted.

Figure 7:
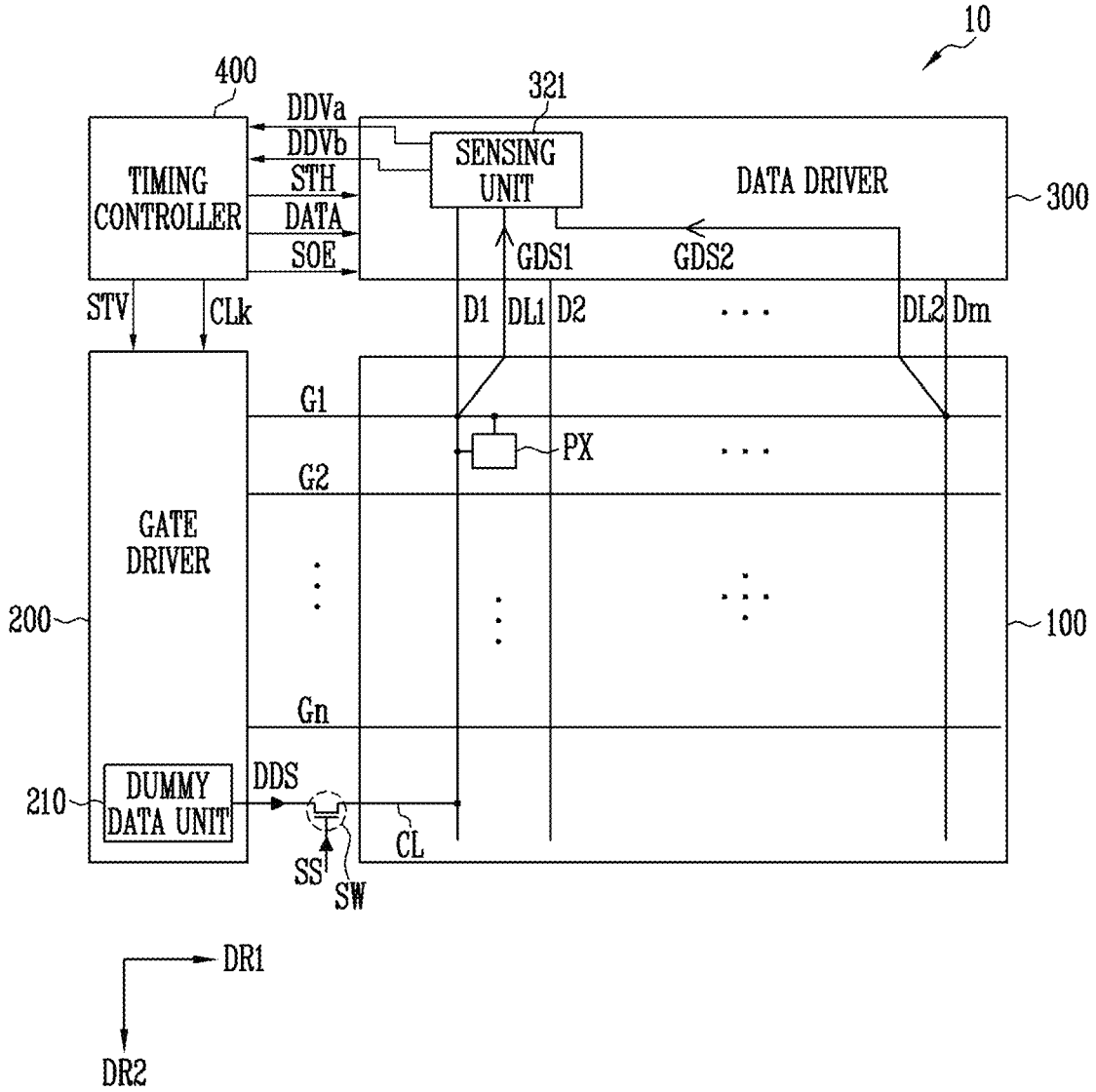
FIG. 7 is a diagram illustrating a display device in accordance with another alternative embodiment of the disclosure.

FIG. 7 is a diagram illustrating a display device in accordance with another alternative embodiment of the disclosure.

In FIG. 7, the same or like elements have been labeled with the same reference characters as used above to describe the embodiment shown in FIG. 1, and any repetitive detailed description thereof will hereinafter be omitted or simplified for convenience of description.

Referring to FIG. 7, in an embodiment, a sensing unit 321 may be electrically connected to at least two points of a specific gate line, and additionally determine a load of the specific gate line by receiving a gate signal supplied at the at least two points.

The specific gate line electrically connected to the sensing unit 321 may be a gate line disposed adjacent to the data driver 300. In an embodiment, the specific gate line may be a first gate line G1 as shown in FIG. 7. Hereinafter, for convenience of description, an embodiment where the specific gate line is the first gate line G1 will be described in detail, but not being limited thereto.

The two points of the first gate line G1 connected to the sensing unit 321 may be two different points among points at which the first gate line G1 and the data lines D1 to Dm intersect each other. In an embodiment, as shown in FIG. 7, the two points may be a point at which the first gate line G1 and the first data line D2 intersect each other and a point at which the first gate line G1 and an m-th data line Dm intersect each other.

In an embodiment, as shown in FIG. 7, the sensing unit 321 is electrically connected to the first gate line G1 at two points, but the disclosure is not limited thereto. In an alternative embodiment, the sensing unit 321 may be electrically connected to the first gate line G1 at three or more points or to a single point.

The sensing unit 321 may be electrically connected to the first gate line G1 at a first point by a first dummy line DL1, and be electrically connected to the first gate line G1 at a second point by a second dummy line DL2.

The sensing unit 321 may be supplied with a first gate delay signal GDS1 from the first point, and be supplied with a second gate delay signal GDS2 from the second point. The sensing unit 321 supplied with the first gate delay signal GDS1 and the second gate delay signal GDS2 may determine a load of the first gate line G1 by using the gate delay signals GDS1 and GDS2, generate a gate sensing data delay value DDVb, corresponding to the determined load, and supply the gate sensing data delay value DDVb to the timing controller 400.

Figure 8A:
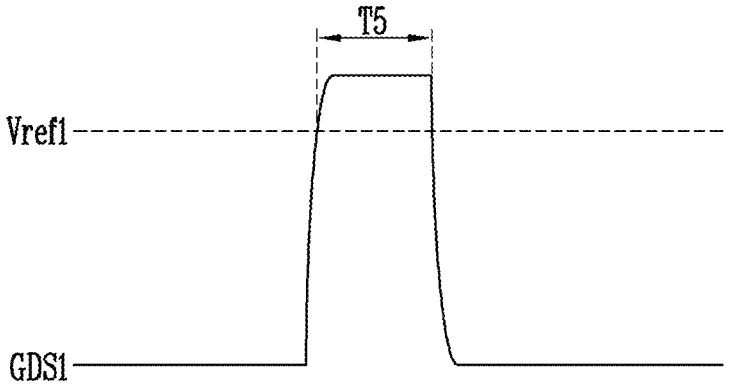
FIG. 8A is a diagram illustrating a first gate delay signal, and 8B is a diagram illustrating a second gate delay signal.

FIG. 8A is a diagram illustrating the first gate delay signal, and 8B is a diagram illustrating the second gate delay signal.

Figure 8B:
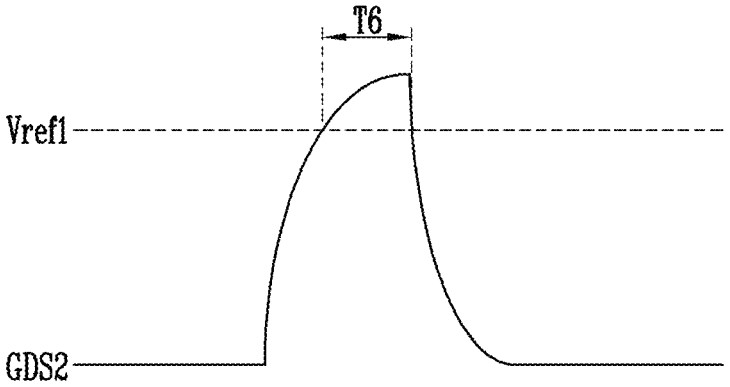

Referring to FIGS. 8A and 8B, the gate delay signals GDS1 and GDS2 have a wavelength (or voltage, etc.) changed corresponding to the load of the first gate line G1. In an embodiment, as compared with a constant reference voltage Vref1, the first gate delay signal GDS1 may be set to a voltage higher than the reference voltage Vref1 during a fifth time period T5 as shown in FIG. 8A.

In such an embodiment, as compared with the reference voltage Vref, the second gate delay signal GDS2 may be set to a voltage higher than the reference voltage Vref1 for a sixth time period T6 shorter than the fifth time period T5 as shown in FIG. 8B.

The load of the first gate line G1 may be determined by using the gate delay signals GDS1 and GDS2. In such an embodiment of the disclosure, the load of the first gate line G1 may be determined by various methods currently known in the art by using the gate delay signals GDS1 and GDS2.

Figure 9:
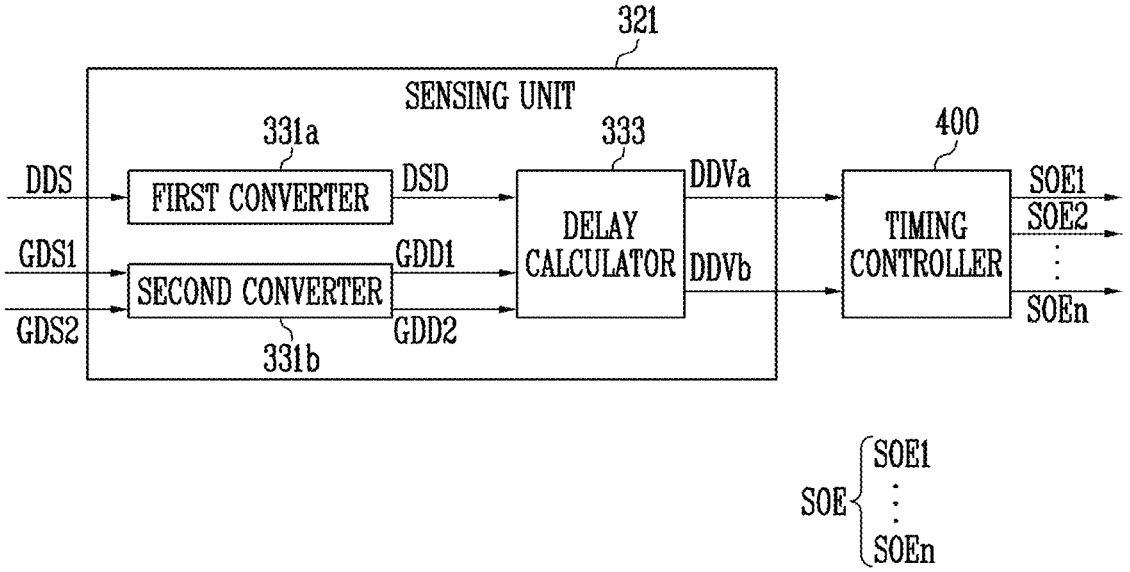
FIG. 9 is a block diagram illustrating an embodiment of a sensing unit shown in FIG. 7.

FIG. 9 is a block diagram illustrating an embodiment of the sensing unit shown in FIG. 7.

In FIG. 9, the same or like elements have been labeled with the same reference characters as used above to describe the embodiment shown in FIG. 3, and any repetitive detailed description thereof will hereinafter be omitted or simplified for convenience of description.

In an embodiment, as shown in FIG. 9, the sensing unit 321 may include a first converter 331*a* and a second converter 331*b*. The first converter 331*a* is substantially the same as the converter 331 shown in FIG. 3, and may convert the dummy data signal DDS in an analog form into dummy delay data DSD.

The second converter 331*b* may convert each of the first gate delay signal GDS1 and the second gate delay signal GDS2 into a digital signal. In such an embodiment, the second converter 331*b* may be an ADC. The second converter 331*b* may convert the first gate delay signal GDS1 in an analog form into first gate delay data GDD1, and convert the second gate delay signal GDS2 in an analog form into second gate delay data GDD2. The gate delay data GDD1 and GDD2 may correspond to a digital value for calculating a charging time of each pixel PX.

In an embodiment, as shown in FIGS. 8A and 8B, the second converter 331*b* may output the first gate delay data GDD1 by comparing the reference signal Vref1 and the first gate delay signal GDS1, and output the second gate delay data GDD2 by comparing the reference voltage Vref1 and the second gate delay signal GDS2. The first gate delay data GDD1 may have a value corresponding to the fifth time period T5, and the second gate delay data GDD2 may have a value corresponding to the sixth time period T6.

The second converter 331*b* may supply the first gate delay data GDD1 and the second gate delay data GDD2 to the delay calculator 333. The delay calculator 333 may calculate a data sensing data delay value DDVa, based on the dummy delay data DSD, and calculate a gate sensing data delay value DDVb, based on the first gate delay data GDD1 and the second gate delay data GDD2. The data sensing data delay value DDVa may be the data delay value DDV shown in FIG. 3.

The delay calculator 333 may determine a load of the first gate line G1 by using the first gate delay data GDD1 and the second gate delay data GDD2, and calculate the gate sensing data delay value DDVb, corresponding to the determined load.

The data sensing data delay value DDVa and the gate sensing data delay value DDVb, which are generated by the delay calculator 332, are supplied to the timing controller 400.

The timing controller 400 may generate source output enable signals SOE1 to SOEn such that loads of the data lines D1 to Dm and the gate lines G1 to Gn may be compensated, based on the supplied delay values DDVa and DDVb.

In an embodiment, the timing controller 400 may generate a plurality of source output enable signals SOE1 to SOEn, based on the gate sensing data delay value DDVb. In an embodiment, the timing controller 400 may output a first source output enable signal SOE1, based on a gate sensing data delay value DDVb corresponding to the smallest load of the first gate line G1, and output an n-th source output enable signal SOEn, based on a gate sensing data delay value DDVb corresponding to the biggest load of the first gate line G1.

In such an embodiment, the timing controller 400 may control a supply timing of the source output enable signals SOE1 to SOEn in a horizontal line unit (or a block unit including a plurality of horizontal lines), corresponding to the data sensing data delay value DDVa.

In an embodiment of the disclosure, the first gate line G1 and the other gate lines G2 to Gn may have a same load as each other. In such an embodiment, the gate lines G1 to Gn formed through a same process are set to have a same load as each other or similar loads to each other, and accordingly, a load of all the other data lines G2 to Gn may be stably determined by using the first gate delay data GDD1 and the second gate delay data GDD2 from one gate line (i.e., the first gate line G1).

Figure 10:
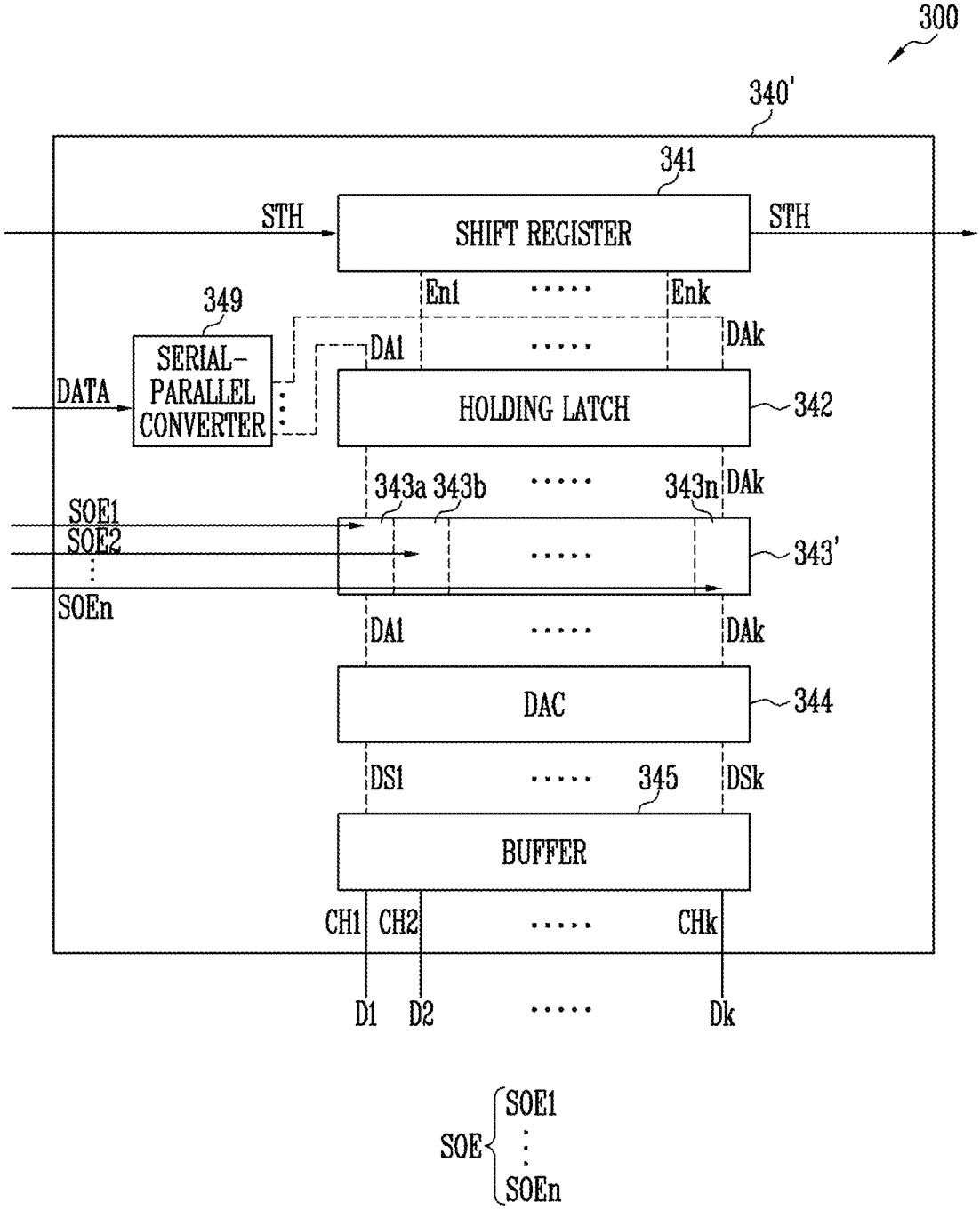
FIG. 10 is a block diagram illustrating one of a plurality of data integrated circuits included in a data driver.

FIG. 10 is a block diagram illustrating one of the plurality of data integrated circuits included in the data driver.

Referring to FIG. 10, the plurality of source output enable signals SOE1 to SOEn may be respectively supplied to a plurality of divided areas 343*a* to 343*n* of a control latch 343'. In an embodiment, the first source output enable signal SOE1 may be supplied to a first area 343*a* of the control latch 343', and the n-th source output enable signal SOEn may be supplied to an n-th area 343*n* of the control latch 343'.

The control latch 343' supplies first to k-th parallel data DA1 to DAk stored therein to the DAC 344, when the plurality of source output enable signals SOE1 to SOEn are supplied. That is, an output timing of the first to k-th parallel data DA1 to DAk of the control latch 343' is controlled by the plurality of source output enable signals SOE1 to SOEn.

The output timing of the plurality of source output enable signals SOE1 to SOEn is controlled based on a load of the data lines D1 to Dm and a load of the gate lines G1 to Gn.

Therefore, the timing controller 400 may supply the plurality of source output enable signals SOE1 to SOEn having different timings from each other for every at least one horizontal line (i.e., one pixel row) and for every at least one vertical line (i.e., one pixel column).

Figure 11A:
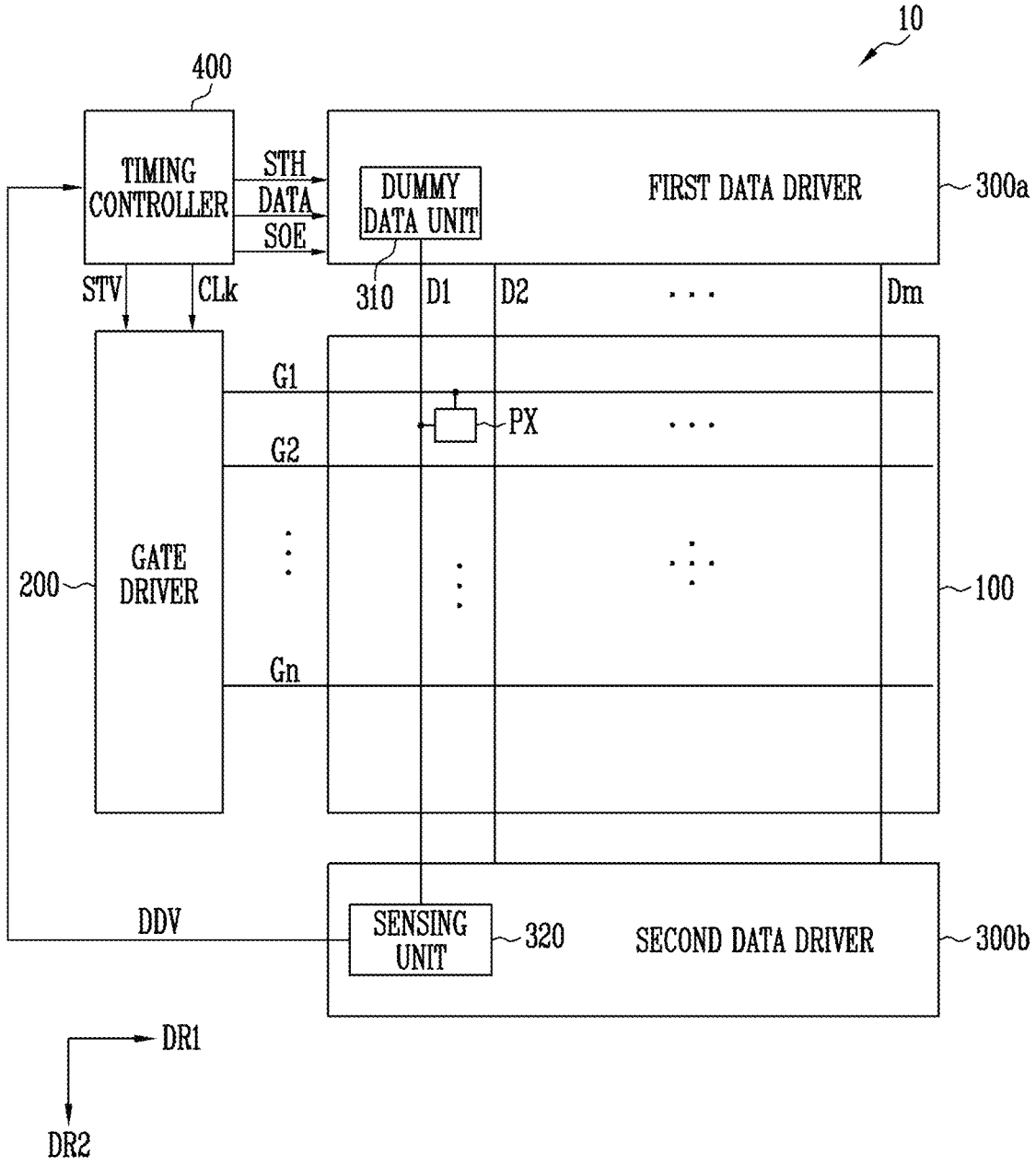
FIGS. 11A to 11C are diagrams illustrating display devices in accordance with other alternative embodiments of the disclosure.
Figure 11B:
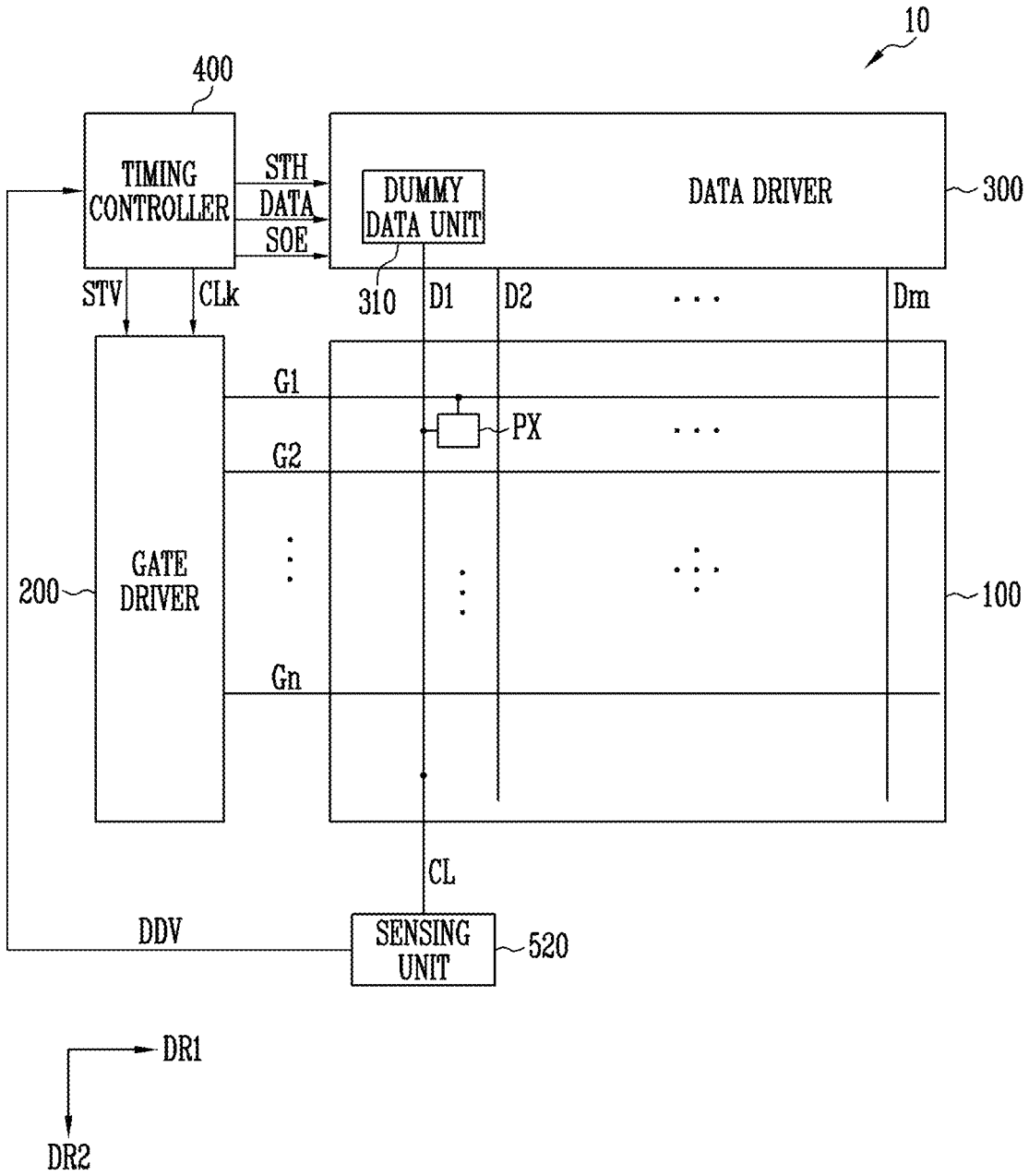
Figure 11C:
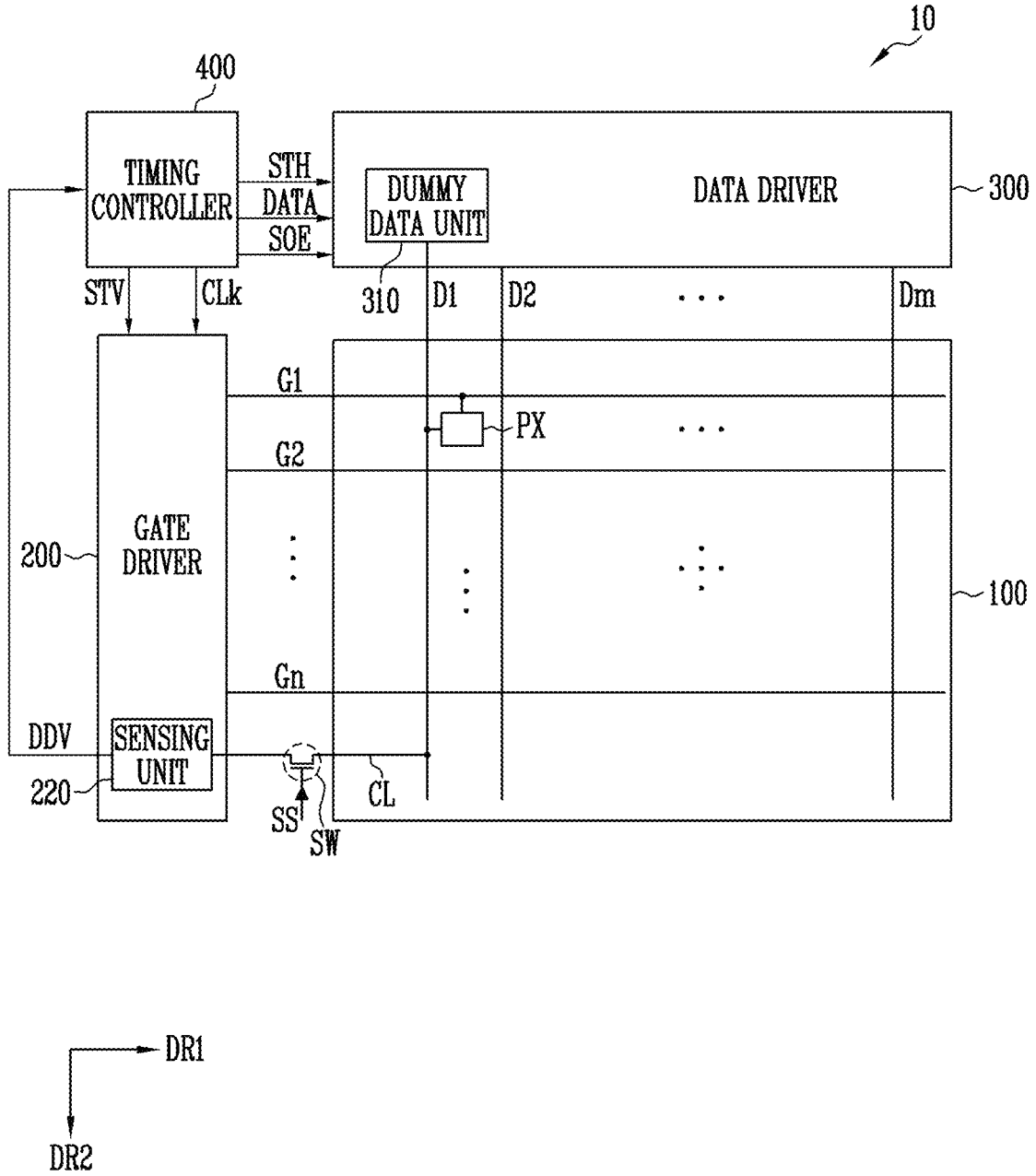

FIGS. 11A to 11C are diagrams illustrating display devices in accordance with other alternative embodiments of the disclosure.

In FIGS. 11A to 11C, the same or like elements have been labeled with the same reference characters as used above to describe the embodiment shown in FIG. 1, and any repetitive detailed description thereof will hereinafter be omitted or simplified for convenience of description.

Referring to FIG. 11A, in an embodiment, the data driver 300 may include a first data driver 300*a* and a second data driver 300*b*.

The first data driver 300*a* may be provided at one side of the display panel 100, and the second data driver 300*b* may be provided at an opposing side of the display panel 100. In an embodiment, the first data driver 300*a* may be provided at an upper side of the display panel 100, and the second data driver 300*b* may be provided at a lower side of the display panel 100.

The dummy data unit 310 may be provided in the first data driver 300*a*, and the sensing unit 320 may be provided in the second data driver 300*b*. However, the disclosure is not limited thereto. In an alternative embodiment, the dummy data unit 310 may be provided in the second data driver 300*b*, and the sensing unit 320 may be provided in the first data driver 300*a*.

The sensing unit 320 disposed in the second data driver 300*b* may determine a load of a data line, e.g., the first data line D1 by receiving a signal supplied from the dummy data unit 310 disposed in the first data driver 300*a*.

Referring to FIG. 11B, in an alternative embodiment, the data driver 300 may be provided at one side of the display panel 100, and a sensing unit 520 may be provided at an opposing side of the display panel 100. In an embodiment, the data driver 300 may be provided at an upper side of the display panel 100, and the sensing unit 520 may be provided at a lower side of the display panel 100.

The dummy data unit 310 may be provided in the data driver 300. The sensing unit 520 may be separately provided with a connection line CL electrically connected to the first data line D1. The sensing unit 520 may determine a load of a data line, e.g., the first data line D1 by receiving a signal supplied from the dummy data unit 310.

Referring to FIG. 11C, in another alternative embodiment, the dummy data unit 310 may be disposed in the data driver 300, and a sensing unit 220 may be disposed in the gate driver 200. The dummy data unit 310 may be electrically connected to one side of the first data line D1, and the other side of the first data line D1 may be electrically connected to a connection line CL.

The connection line CL may be electrically connected to the sensing unit 220, and a switching element SW may be provided or connected between the sensing unit 220 and the connection line CL. The sensing unit 220 may be supplied with a signal supplied to the first data line D1, when the switching element SW is turned on. The sensing unit 220 may determine a load of a data line, e.g., the first data line D1 by receiving a signal supplied from the dummy data unit 310.

Referring to FIGS. 11A to 11C, in embodiments, the dummy data unit 310 may be separately provided in the data driver 300*a* or 300, but the disclosure is not limited thereto. In an alternative embodiment, the dummy data unit 310 may be configured as or defined by a portion in the data integrated circuit 340 shown in FIGS. 5 and 11. A signal received to the sensing unit 320 or 520 may be one data signal DS among data signals supplied from the data driver 300*a* or 300.

Figure 12:
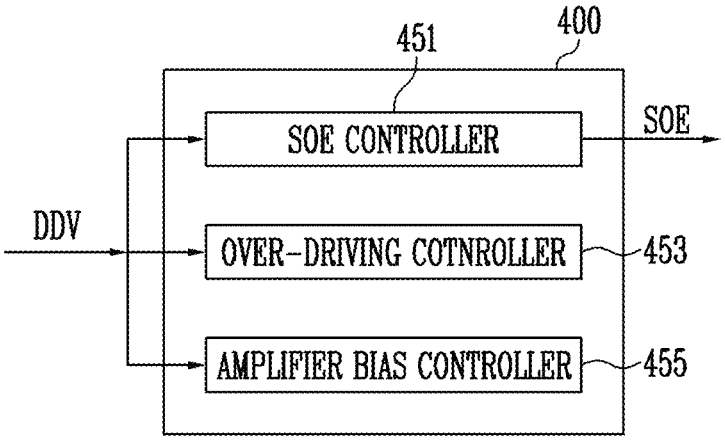
FIG. 12 is a block diagram illustrating a timing controller in accordance with embodiments of the disclosure.

FIG. 12 is a block diagram illustrating a timing controller in accordance with embodiments of the disclosure.

An embodiment of the timing controller 400 may include a source output enable signal controller 451 (hereinafter, referred to as an "SOE controller"), an over-driving controller 453, and an amplifier bias controller 455.

The SOE controller 451 may control an output timing of the source output enable signal SOE, based on the data delay value DDV as previously described.

The over-driving controller 453 may supply an over-driving voltage by comparing previous data and current data when a data signal is supplied. The over-driving controller 453 may be additionally supplied with a data delay value DDV, and additionally control the over-driving voltage such that a load of the data lines D1 to Dm and/or the gate lines G1 to Gn, which corresponds to the data delay value DDV, is compensated.

In an embodiment, the over-driving controller 453 may supply a high over-driving voltage, corresponding to a first level value having the biggest data delay value DDV, and supply a low over-driving voltage, corresponding to a second level value having the smallest data delay value DDV.

The amplifier bias controller 455 may generate a bias current. The bias current generated by the amplifier bias controller 455 is supplied to the buffer shown in FIGS. 5 and 10. In an embodiment, a buffer (i.e., an amplifier) is included in a channel of each of the data integrated circuits 340 and 340', and the amplifier bias controller 455 controls a bias current to each buffer. The amplifier may supply data having different slew rates, corresponding to the bias current.

The amplifier bias controller 455 may be additionally supplied with a data delay value DDV, and supply a bias current such that a load of the data lines D1 to Dm and/or the gate lines G1 to Gn is compensated based on the data delay value DDV. In an embodiment, the amplifier bias controller 455 may supply a bias current having a high value, corresponding to a first level value having the biggest data delay value DDV, and supply a bias current having a low value, corresponding to a second level value having the smallest data delay value DDV.

In an embodiment of the invention, the display device controls the supply timing of a data signal supplied to a data line, based on a data load, so that a voltage charging time of the pixel may be secured. Accordingly, in such an embodiment, the charging rate of the pixel may be improved, and the quality of an image displayed in the display device may be improved.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a dummy data unit connected to one end portion of a data line, wherein the dummy data unit supplies a dummy data signal to the data line, and the data line is connected to a pixel;

a sensing unit connected to an opposing end portion of the data line, wherein the sensing unit senses a load of the data line based on the dummy data signal supplied thereto through the data line;

a timing controller which controls a supply timing of a data signal to be supplied to the data line, based on the load of the data line;

a connection line electrically connecting the dummy data unit and the data line to each other; and a switching element connected between the connection line and the dummy data unit.

2. The display device of claim 1, further comprising:

a data driver which supplies the data signal to the data line; and a gate driver which supplies a gate signal to a gate line.

3. The display device of claim 2, wherein the dummy data unit is disposed in the gate driver, and the sensing unit is disposed in the data driver.

4. The display device of claim 1, wherein the data line supplied with the dummy data signal is disposed adjacent to the gate driver.

5. The display device of claim 1, wherein the switching element is turned on when the dummy data signal is supplied to the data line, and the switching element maintains a turn-off state when the data signal is supplied to the data line.

6. The display device of claim 1, wherein the sensing unit includes:

a converter which converts the dummy data signal into dummy delay data in a digital form; and a delay calculator which generates a data delay value based on the dummy delay data.

7. The display device of claim 6, wherein the data delay value is a first data delay value corresponding to a biggest load of the data line.

8. The display device of claim 7, wherein the delay calculator pre-stores a second data delay value corresponding to a smallest load and additionally calculates a third data delay value corresponding to an intermediate load based on the first data delay value and the second data delay value.

9. The display device of claim 2, wherein the data driver includes:

a shift register which generates an activation signal;

a holding latch which is supplied with and sequentially stores data from the timing controller in response to the activation signal;

a control latch simultaneously supplied with the data stored in the holding latch when a source output enable signal is supplied thereto;

a digital-to-analog converter which is supplied with the data from the control latch when the source output enable signal is supplied to the control latch and generates the data signal based on the data supplied thereto from the control latch; and a buffer which transfers the data signal to the data line.

10. The display device of claim 9, wherein the timing controller controls a supply timing of the data signal by changing a supply timing of the source output enable signal.

11. The display device of claim 2, wherein the dummy data unit is disposed at one end portion of the gate driver, and the sensing unit is disposed at an opposing end portion of the gate driver.

12. The display device of claim 11, further comprising:

a first connection line electrically connecting the dummy data unit and the data line to each other;

a second connection line electrically connecting the sensing unit and the data line to each other;

a first switching element connected between the first connection line and the dummy data unit; and a second switching element connected between the second connection line and the sensing unit.

13. The display device of claim 11, wherein a line electrically connecting the dummy data unit and the sensing unit to each other is a dummy data line.

14. The display device of claim 2, wherein the sensing unit is electrically connected to at least two points of a specific gate line and determines a load of the specific gate line based on a gate signal supplied thereto from the at least two points.

15. The display device of claim 14, wherein the specific gate line is disposed adjacent to the data driver.

16. The display device of claim 14, wherein the sensing unit includes:

a first converter which converts the dummy data signal into dummy delay data in a digital form;

a second converter which converts the gate signal from the at least two points into gate sensing data in a digital form; and a delay calculator which generates a data delay value based on the dummy delay data and the gate sensing data.

17. The display device of claim 2, wherein the data driver includes:

a first data driver disposed at one side of a display panel; and a second data driver disposed at an opposing side of the display panel, and wherein the dummy data unit is disposed in the first data driver, and the sensing unit is disposed in the second data driver.

18. The display device of claim 2, wherein the dummy data unit is disposed in the data driver disposed at one side of a display panel, and the sensing unit is disposed at an opposing side of the display panel or in the gate driver, and wherein the display device further comprises another connection line electrically connecting the sensing unit and the data line to each other.

19. The display device of claim 2, wherein the timing controller further includes:

a source output enable signal controller which controls a supply timing of the data signal;

an over-driving controller which controls an over-driving voltage, based on the load; and an amplifier bias controller which controls a bias current to be supplied to amplifiers included in the data driver, based on the load.

* * * * *